US008490452B2

(12) United States Patent
Harada et al.

(10) Patent No.: US 8,490,452 B2
(45) Date of Patent: Jul. 23, 2013

(54) METHOD FOR PRODUCING SEAMLESS TUBES

(75) Inventors: Kouichi Harada, Osaka (JP); Tomio Yamakawa, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/205,985

(22) Filed: Aug. 9, 2011

(65) Prior Publication Data

US 2012/0047981 A1 Mar. 1, 2012

Related U.S. Application Data

(63) Continuation of application No. PCT/JP2010/052015, filed on Feb. 12, 2010.

(30) Foreign Application Priority Data

Feb. 13, 2009 (JP) ..... 2009-031404

(51) Int. Cl.

| | |
|---|---|
| ***B21C 23/00*** | (2006.01) |
| ***B21C 23/04*** | (2006.01) |
| ***B21C 31/00*** | (2006.01) |
| ***B21C 1/00*** | (2006.01) |

(52) U.S. Cl.
USPC ..... 72/253.1; 72/264; 72/271; 72/700

(58) Field of Classification Search
USPC ..... 72/253.1, 264, 271, 268, 700
See application file for complete search history.

(56) References Cited

U.S. PATENT DOCUMENTS

| | | | | |
|---|---|---|---|---|
| 3,580,038 | A * | 5/1971 | Andreassian | 72/264 |
| 7,866,199 | B2 * | 1/2011 | Hirase et al. | 72/700 |

FOREIGN PATENT DOCUMENTS

| | | |
|---|---|---|
| JP | 05-261427 | 10/1993 |
| JP | 2002-192222 | 7/2002 |
| JP | 2004-174536 | 6/2004 |
| JP | 2005-219123 | 8/2005 |
| WO | 2008/081866 | 7/2008 |

* cited by examiner

*Primary Examiner* — Dana Ross
*Assistant Examiner* — Mohammad I Yusuf
(74) *Attorney, Agent, or Firm* — Clark & Brody

(57) ABSTRACT

Provided is a method for producing a seamless tube, in which after a starting material to be extruded has been heated to a heating temperature T [° C.] satisfying the relationship of Formula (1) or Formula (2) depending on the outside diameter $d_0$ [mm] thereof, the starting material is hot extruded by providing a solid lubricating glass between the starting material to be extruded and a die, whereby a transverse flaw on the outer surface in the top portion of tube can be prevented when hot extrusion is performed by using a starting material for extrusion having low deformability at high temperatures. When $d_0<200$, $T \leqq 1250+1.1487\times A-7.838\times \ln(t_0/t)-10.135\times \ln(d_0/d)$ . . . (1); when $d_0 \geqq 200$, $T \leqq 1219+1.1487\times A-7.838\times \ln(t_0/t)-10.135\times \ln(d_0/d)$ . . . (2), where $A=L/V_{av}\times 1000$ [msec.]. $V_{av}=(V_0+V_0\times\rho)/2$ [mm/sec], $\rho=(t_0\times(d_0-t_0))/(t\times(d-t))$, $t_0$: wall thickness of starting material to be extruded [mm], d: outside diameter of extruded tube [mm], t: wall thickness thereof [mm], L: length of approach portion of die along extrusion direction [mm], and $V_0$: ram speed [mm/sec].

4 Claims, 3 Drawing Sheets

METHOD FOR PRODUCING SEAMLESS TUBES

TECHNICAL FIELD

The present invention relates to a method for producing a seamless tube, which uses a hot extrusion tube-making process. More particularly, the present invention relates to a method for producing a seamless tube, which is suitable when using a blank material to be extruded having low deformability at high temperatures.

BACKGROUND ART

In recent years, in the course of combating global warming, there is a demand for a high-capacity power generating plant, and high-efficiency ultra super critical power generation boilers have been developed actively. Also, with the prevalence of oil depletion problem, an oil and natural gas exploitation environment has become much more hostile. In the power generation boilers, oil wells, and gas wells, used is a seamless tube which is excellent in strength, corrosion resistance, and stress corrosion cracking resistance, and the material grade of the seamless tube tends to be high-Cr and high-Ni alloys in response to such escalated requirements in application.

Because of poor workability of high-Cr and high-Ni materials, there are growing demands for seamless tubes produced by a hot extrusion tube-making process, as a method for producing tubes from such hard-to-work materials in which features in high working speed, less temperature drop of in-process material, and achieving a high reduction rate. In particular, the Ugine-Sejournet process characterized by glass lubrication is suitable for producing a seamless tube from a hard-to-work material.

FIG. 1 is a sectional view for illustrating the hot extrusion tube-making process for making a seamless tube by using the Ugine-Sejournet process. As shown in FIG. 1, in the Ugine-Sejournet process, a hollow starting material to be extruded (hereinafter, also referred to as a "billet") 8 with a through hole formed in along the axial centerline thereof is heated, and the billet 8 heated to a predetermined temperature is housed in a container 6. Thereafter, with a mandrel bar 3 inserted in the axial center of the billet 8, the billet 8 is extruded via a dummy block 7 by the movement (in the direction indicated by the hollow arrow in FIG. 1) of a stem along with a ram, not shown, being driven to produce an extruded tube as being a seamless tube.

At this time, a die 2 held by a die holder 4 and a die backer 5 is arranged at the front end of the container 6, and the billet 8 is extruded in the stem movement direction through an annular gap formed by the inner surface of the die 2 and the outer surface of the mandrel bar 3 to form an extruded tube having a desired outside diameter and wall thickness.

In the Ugine-Sejournet process, glass is used as a lubricant. Before the billet 8 is housed in the container 6, powder glass is provided onto the outer surface and the inner surface of the heated billet 8 to form a film of molten glass. This glass film lubricates between the billet 8 and the container 6 as well as between the billet 8 and the mandrel bar 3.

In addition, a glass disc 1 formed in an annular shape by mixing powder glass with glass fiber and water glass is mounted between the billet 8 and the die 2. This glass disc 1 is melted gradually in the process of extrusion by the heat retained by the billet 8, and lubricates between the billet 8 and the die 2.

In the above-described hot extrusion tube-making process, the billet temperature during extrusion depends on the billet heating temperature, the heat dissipation caused by heat transfer to tools (container, mandrel bar, and die), and the heat generation associated with plastic deformation. If the heat dissipation of billet is significant, the billet temperature decreases, and the deformation resistance increases, so that the load imposed on the tube-making equipment becomes excessive, which may result in incompletion of extrusion and hence may become a hindrance in terms of operation and yield. If the billet heating temperature is increased excessively to avoid the problem, flaws occur on the extruded tube because of decreasing into a low ductility region in the high-temperature zone, and the yield is decreased by the product defective. In particular, on the outer surface of the top portion (the portion of the extrusion front) of extruded tube, flaws in a transverse direction, which is called a transverse/lateral flaw, is prone to occur.

In general, the high-Cr and high-Ni materials have high deformation resistance, and temperatures exhibiting good high-temperature ductility (the temperature at which the reduction of area is 90% or more in the high-temperature tensile test) are low, and the range of the temperatures is narrow, so that the deformability is low at high temperatures. Therefore, in the hot extrusion using a high-Cr and high-Ni materials as starting material to be extruded, the hindrance in terms of operation and yield caused by the incompletion of extrusion and the decrease in yield caused by flaws on the extruded tube become significant. Therefore, in order to produce a high-quality extruded tube by using a billet having low deformability at high temperatures, it is necessary to grasp the ductility decreasing temperature in the high-temperature zone and also to take into consideration the processing-incurred heat.

As a method for ensure the quality of extruded tube, for example, Patent Literatures 1 and 2 disclose a method for extruding a metal material, in which a conditional expression based on the container temperature is defined, and extrusion is performed so that the temperature of extruded tube remains constant.

CITATION LIST

Patent Literature

Patent Literature 1: Japanese Patent Application Publication No. 2002-192222

Patent Literature 2: Japanese Patent Application Publication No. 2005-219123

SUMMARY OF INVENTION

Technical Problem

In the extrusion method disclosed in Patent Literatures 1 and 2, it is practically difficult to control the ever-changing container temperature, and this method has a disadvantage that the conditional expression cannot be defined unless the physical characteristics are grasped for each material grade to be worked.

The extrusion using the above-described high-Cr and high-Ni materials as starting material to be extruded is performed at the ram speed of 50 mm/sec or mere and the billet heating temperature of 1000° C. or more. On the other hand, the extrusion disclosed in Patent Literatures 1 and 2 is performed by using aluminum or its alloys and at the ram speed of merely 10 mm/sec or less and the billet heating temperature as low as about 600° C. That is, the extrusion using the high-Cr and high-Ni materials as starting material to be extruded is performed under an extruding condition significantly different from that of the extrusion disclosed in Patent Literatures 1 or 2, which is done under a tremendously harsh condition.

When the above-described high-Cr and high-Ni materials are hot extruded, the lubricating glass specific to the Ugine-Sejournet process may well be involved as a cause of transverse flaws on the outer surface of tube. The reason is that since the lubricating glass has a thermal conductivity that is two orders of magnitude less than those of the billet and tools in contact with the lubricating glass, the billet temperature may vary depending on the presence or absence of the lubricating glass. Meanwhile, in the extrusion method disclosed in Patent Literatures 1 and 2, the lubricant is not considered at all. Therefore, the extrusion method disclosed in Patent Literatures 1 and 2 cannot be a technology for preventing a transverse flaw on the outer surface in the top portion of tube.

The present invention has been made to solve the above problems, and accordingly an objective thereof is to preside a method for producing a seamless tube, which is capable of preventing a transverse flaw on the outer surface in the top portion of tube even in the case where hot extrusion is performed using a billet having low deformability at high temperatures, such as a high-Cr and high-Ni materials.

Solution to Problem

To achieve the above object, the present inventors investigated the deformation behavior and temperature distribution of a starting material to he extruded during extrusion, and repeatedly conducted studies earnestly. As the result, the present inventors found that transverse flaws on the outer surface in the top portion of tube are caused by the phenomenon that the surface temperature of the extruded tube is made higher than the heating temperature at the initial stage of extrusion by both the adiabatic action of a solid lubricating glass provided between the starting material to be extruded and the die and the processing-incurred heat of the starting material to be extruded itself. That is, the present inventors obtained a finding that when a material having low deformability at high temperatures is hot extruded, the amount of processing-incurred heat may be predicted quantitatively and the heating temperature of the starting material to be extruded may be controlled depending on the outside diameter of the starting material to be extruded to prevent a transverse flaw without an excessive spike of the surface temperature of the extruded tube.

The present invention was completed based on the above-described finding, and the gist thereof is a method for producing a seamless tube, in which when a hollow starting material to be extruded is hot extruded by providing a solid lubricating glass between the starting material to be extruded and a die after the hollow starting material has been heated, the starting material is hot extruded by being heated to a heating temperature T satisfying the relationship of Formula (1) or Formula (2) depending on the outside diameter $d_0$ [mm] thereof.

When $d_0<200$ $$T \leqq 1250+1.1487\times A-7.838\times\ln(t_0/t)-10.135\times\ln(d_0/d) \quad (1)$$

When $d_0 \geqq 200$:

$$T \leqq 1219+1.1487\times A-7.838\times\ln(t_0/t)-10.135\times\ln(d_0/d) \quad (2)$$

Where A in Formulae (1) and (2) is determined by Formula (3).

$$A=L/V_{av}\times 1000 \quad (3)$$

where $V_{av}$ in Formula (3) is determined by Formula (4)

$$V_{av}=(V_0+V_0\times\rho)/2 \quad (4)$$

where ρ in Formula (4) is determined by Formula (5).

$$\rho=(t_0\times(d_0-t_0)\times\pi)/(t\times(d-t)\times\pi) \quad (5)$$

where the symbols in Formulae (1) to (5) denote the following:

$d_0$: outside diameter of starting material to be extruded [mm]

$t_0$: wall thickness of starting material to be extruded [mm]

d: outside diameter of extruded tube [mm]

t: wall thickness of extruded tube [mm]

A: die passing time [msec (millisecond)]

L: length of approach portion along extrusion direction from its inlet end to the entry end of the following bearing portion [mm]

$V_{av}$: average extrusion speed of starting material to be extruded [mm/sec]

$V_0$: ram speed [mm/sec]

ρ: extrusion ratio.

In the above-described production method, a material containing, in mass %, Cr: 15 to 35% and Ni: 3 to 50% is preferably used as the starting material to be extruded.

Also, in above-described production method, the average thickness of the solid lubricating glass is preferably 6 mm or more.

Advantageous Effects of Invention

According to the method for producing a seamless tube in accordance with the present invention, when hot extrusion is performed by using a starting material to be extruded having low deformability at high temperatures, such as a high-Cr and high-Ni materials, the starting material to be extruded is heated to the heating temperature satisfying a conditional expression taking the amount of processing-incurred heat into account depending on the outside diameter of the starting material to be extruded, whereby the temperature exhibiting good high-temperature ductility can be ensured, and a transverse flaw on the outer surface in the top portion of an extruded tube can be prevented without an excessive spike of the surface temperature of the extruded tube at the initial stage of extrusion.

DESCRIPTION OF EMBODIMENTS

The production method in accordance with the present invention is a method for producing a seamless tube in which, as described above, when a hollow starting material for extrusion is hot extruded by providing a solid lubricating glass between the starting material and a die after the hollow starting material has been heated, the starting material is hot extruded by being heated to a heating temperature T [° C.] satisfying the relationship of Formula (1) or Formula (2)

depending on the outside diameter $d_0$ [mm] thereof. Hereunder, explained are the reason why the production method of the present invention is defined as described above, and the preferred modes of the production method.

1. Heating Temperature of Starting Material to be Extruded

To find out a cause for transverse flaws on the outer surface in the top portion of tube, the deformation behavior of the starting material to be extruded in the Ugine-Sejournet process and the temperature distribution of the starting material during extrusion based on the deformation behavior thereof were investigated by using the two-dimensional FEM analysis. In the FEM analysis, as the starting material to be extruded, an austenitic stainless steel (SUS347H in JIS Standard) was used as an example of material having lower deformability at high temperatures, and analysis was conducted by variously varying the conditions of the outside diameter and wall thickness of the starting material to be extruded, the heating temperature of the starting material, and the ram speed.

1-1 Deformation Behavior of Starting Material to be Extruded

Figure 1:
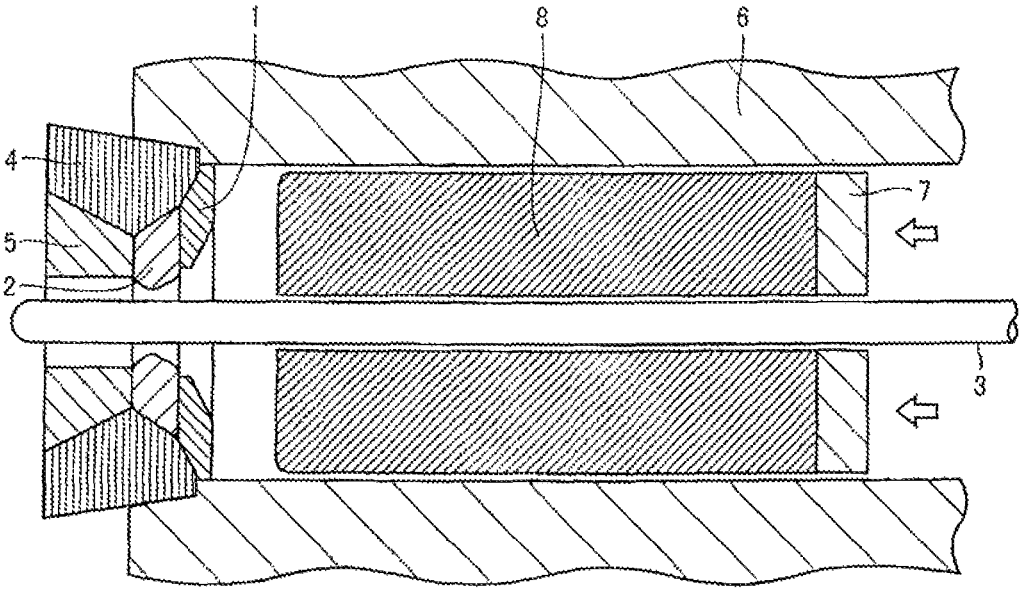
FIG. 1 is a sectional view for illustrating a hot extrusion tube-making process for a seamless tube using the Ugine-Sejournet process.
Figure 2A:
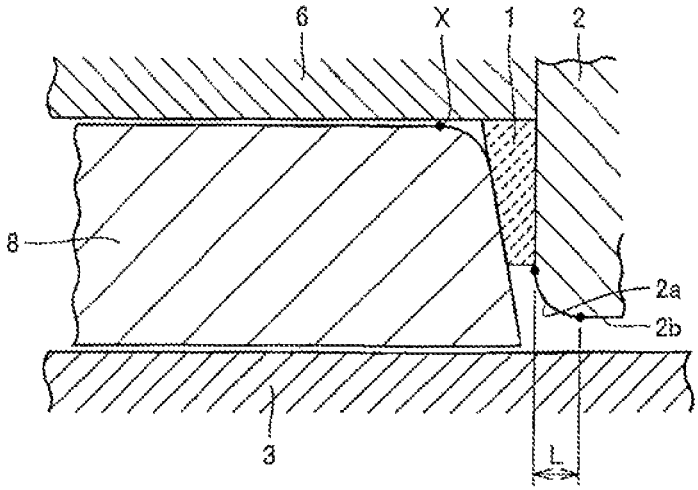
FIG. 2A showing just before the extrusion starts, and FIG. 2B showing the initial stage of extrusion.
Figure 2B:
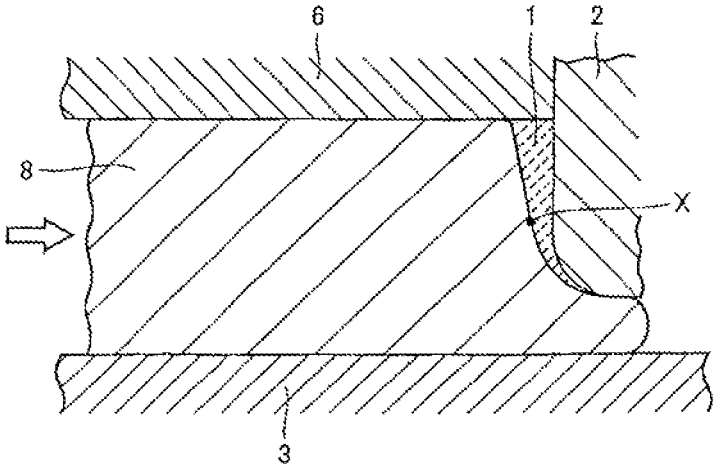
FIG. 2 is schematic views showing the deformation behavior of a starting material to be extruded in the Ugine-Sejournet process.

FIG. 2 is schematic views showing the deformation behavior of the starting material to be extruded in the Ugine-Sejournet process, FIG. 2A showing just before the extrusion starts, and FIG. 2B showing the initial stage of extrusion. In FIG. 2B, the direction in which the starting material (billet) is extruded is indicated by hollow arrows.

As shown in FIG. 2A, a billet 8 having been heated and housed in a container 6 is made in an upset state by a mandrel bar 3 inserted into the billet 8. From this state, a ram is driven, and the rear end surface of the billet 8 is pressed via a dummy block by the movement of a stem along with the ram being driven, whereby the extrusion is started. When the extrusion is started, the billet 8 is pushed in toward a die 2. At this time, the billet 8 is deformed until the outer surface of billet comes into contact with the inner surface of the container 6 via a glass film, and also the billet 8 is deformed until the inner surface of billet comes into contact with the outer surface of the mandrel bar 3 via the glass film.

At this time, since the outer peripheral portion at the front end of the billet 8 has been chamfered in advance, the chamfer portion does not come into contact with the inner surface of the container 6. That is, on the fore end portion in front of the chamfer start point indicated by the symbol "X" in FIG. 2A, the billet 8 does not contact with the inner surface of the container 6, and the outer surface on the other portion behind the chamfer start point X of the billet 8 comes into contact with the inner surface of the container 6. At the same time, the fore end surface of the billet 8 comes into contact with the die 2 via a glass disc 1 formed of solid lubricating glass.

When the stem is moved successively, as shown in FIG. 2B, the billet 8 is pushed and its front end portion flows into an annular gap between the inner surface of the die 2 and the outer surface of the mandrel bar 3 with the glass disc 1 being interposed between the billet 8 and the die 2.

As shown in FIG. 2A, the inner surface of the die 2 comprises an approach portion 2*a* having a decreasing diameter and a bearing portion 2*b* having a constant diameter, in order along the extrusion direction. The billet 8 is formed so as to have a desired outside diameter by passing through the approach portion 2*a* and the bearing portion 2*b* successively, and thereby an extruded tube is formed. At this time, in the range of the length L of the approach portion 2*a* along the extrusion direction from its inlet end to the entry end of the bearing portion 2*b*, the billet 8 is plastically deformed abruptly, and the strain rate becomes extremely high.

1-2 Temperature Distribution of Workpiece During Extrusion

Based on the above-described deformation behavior, the temperature distribution of the workpiece during extrusion was FEM-analyzed, with a result that the findings described below were obtained.

Immediately after the start of extrusion, on the outer surface of the billet, heat dissipation is accelerated by heat transfer caused by the contact of the outer surface of the billet with the inner surface of the container, and the decrease in temperature occurs. Similarly, on the inner surface of the billet, heat dissipation is accelerated by heat transfer caused by the contact of the inner surface of the billet with the outside surface of the mandrel bar, and greater decrease in temperature occurs. That is, the outer and inner surfaces of the billet become in a low temperature state.

Meanwhile on the fore end surface of the billet, by the adiabatic action of the glass disc contacting therewith, heat dissipation into the die is restrained, so that the decrease in temperature becomes small as compared with the outer and inner surfaces of the billet. This is because the thickness of the glass disc immediately after the start of extrusion remains sufficiently large. In the chamfer portion in the outer peripheral portion at the fore end of billet, since this portion does not come into contact with the inner surface of the container, heat dissipation is not accelerated, and moreover the decrease in temperature is small by the adiabatic action of the thick glass disc. That is, the fore end surface and the chamfer portion of billet are kept in a high temperature state.

With the advance in extrusion, the billet is pushed and processed so that the fore end surface, the chamfer portion, and the outer surface thereof successively move and flow along the inner surface of the die. In particular, in the process of passing through the approach portion of the die, heat is generated by a sudden plastic metal flow. The extent of the heat generation remains the same, irrespective of the fore end surface, the chamfer portion, and the main outer surface of billet passing through the die.

At this time, when the fore end surface and the chamfer portion of the billet pass through the die, in the earlier stage, the fore end surface and the chamfer portion of the billet are kept in a high temperature state by the adiabatic action of the glass disc. Therefore, the surface temperature of the extruded tube is further raised by the addition of large processing-incurred heat, and becomes higher than the heating temperature. In this case, the surface temperature of the extruded tube becomes higher than the temperature of the mid wall portion even subjected to moderate processing-incurred heat.

Meanwhile, when the main outer surface of the billet passes through the die, at the earlier stage, the glass disc is melted and thinned by the billet heat dissipation to the container and further with the advance of extrusion, and the surface temperature of the extruded tube is decreased by the heat dissipation to the die through the thinned glass disc. Therefore, even if the processing-incurred heat is added, the surface temperature of the extruded tube does not increase so much, and becomes lower than the heating temperature. In this case, the surface temperature of the extruded tube becomes lower than the temperature of the mid wall subjected to processing heat generation.

From the situation of such a temperature distribution, it is apparent that when a portion including the fore end surface and the chamfer portion of the billet that is, a portion on the fore end side of the chamfer starting point X (shown in FIG. 2A) on the billet (hereinafter, referred also to as a "on-steady portion") is pushed out, the surface temperature of the extruded tube is raised as compared with the heating temperature by the adiabatic action of the glass disc and the workingincurred heat of the billet itself, and is liable to reach the ductility decreasing temperature in the high-temperature zone. This is the cause of transverse flaws on the outer surface in the top portion of the tube.

In the case where the outside diameter $d_0$ of the billet is large, since the heat capacity of the billet itself is high, the decrease in temperature of billet is restrained, and resultantly the extent of the increase in surface temperature of the extruded tube is prone to become large.

Also, the extent of the increase in surface temperature of the extruded tube depends on the working reduction rate. This is because as the working reduction rate increases, the amount of processing-incurred heat increases. The working reduction rate in this description corresponds to the ratio of the wall thickness $t_0$ of billet to the wall thickness t of extruded tube $[t_0/t]$, the ratio of the outside diameter $d_0$ of billet to the outside diameter d of extruded tube $[d_0/d]$, and the extrusion rate ρ represented by the ratio of the average cross-sectional area of billet to the average cross-sectional area of extruded tube $[t_0\times(d_0-t_0)\times\pi)/(t\times(d-t)\times\pi)]$.

Further, the extent of the increase in surface temperature of the extruded tube depends on the ram speed $V_0$. This is because as the ram speed $V_0$ increases, the average extrusion speed $V_{av}$ $[=(V_0+V_0\times\rho)/2]$ of billet increases, and the amount of processing-incurred heat is increased b the increase in the strain rate corresponding to the increasing average extrusion speed of billet. This exerts an effect on time A $[=L/V_{av}\times1000]$ spent during when the billet passes through the length L in the extrusion direction of the approach portion on the die, and as the ram speed $V_0$ increases, the die passing time A is reduced, and the amount of processing-incurred heat increases.

For these reasons, when a material having low deformability at high temperature is hot extruded, depending on the outside diameter of the billet, the amount of processing-incurred heat is predicted quantitatively based on the working reduction rate and the die passing time, and the heating temperature of the billet is controlled while taking the amount of processing-incurred heat into account, whereby the temperature exhibiting good high-temperature ductility can be ensured and transverse flaws on the outer surface in the top portion of the extruded tube can be suppressed without an excessive spike of the surface temperature in the unsteady portion at the initial stage of extrusion.

Based on the above-described findings and the after-described results of examples, the heating condition was formulize, thus obtaining conditional expressions of heating temperature represented by Formulae (1) and (2).

In Formulae (1) and (2), to prevent an excessive temperature spike on the surface of extruded tube, the upper limit of the heating temperature of billet is defined. The lower limit of the heating temperature of billet is preferably 1100° C. The reason for this is that if the heating temperature is too low, the surface temperature does not reach the temperature exhibiting good high-temperature ductility, the deformability decreases, and surface flaws are prone to occur. Also, the reason for this is that as the heating temperature decreases, the deformation resistance becomes high, and the load on the tube-making equipment increases during extrusion.

2. Thickness of Solid Lubricating Glass

As described above, the cause for transverse flaws is the excessive spike of the surface temperature in the unsteady portion, and the excessive spike of the surface temperature is caused by the adiabatic action of the glass disc. Therefore, the preferred thickness of the glass disc, that is, the solid lubricating glass provided between the starting material to be extruded and the die, is studied.

Tests for producing an extruded tube having an outside diameter of 76.8 mm and an inside diameter of 63 mm were conducted. In these tests, as the starting material to be extruded, an austenitic stainless steel (SUS347H in the JIS standards) having an outside diameter of 178 mm and an inside diameter of 66 mm and having a representative composition given in Table 1 was used, and billets made of this stainless steel were heated to 1200° C. and thereafter subjected to hot extrusion under the conditions in which the average thickness of glass disc and the ram speed were varied variously. By varying the average thickness of glass disc in the range of 0 to 10 mm, and by setting the ram speed at 100, 150, and 200 mm/sec, one hundred lengths of extruded tubes were produced for each condition. The average thickness of 0 mm for the glass disc means that no glass disc is provided.

TABLE 1

Unit: mass %

| C | Si | Mn | P | S | Ni | Cr | Nb |
|---|---|---|---|---|---|---|---|
| 0.09 | 0.50 | 1.53 | 0.023 | 0.001 | 11.30 | 17.50 | 0.96 |

On each of the extruded tubes obtained by the extrusion tests conducted under the conditions, the entire zone of the outer surface was observed visually to examine the status of occurrence of outer surface flaws.

Figure 3:
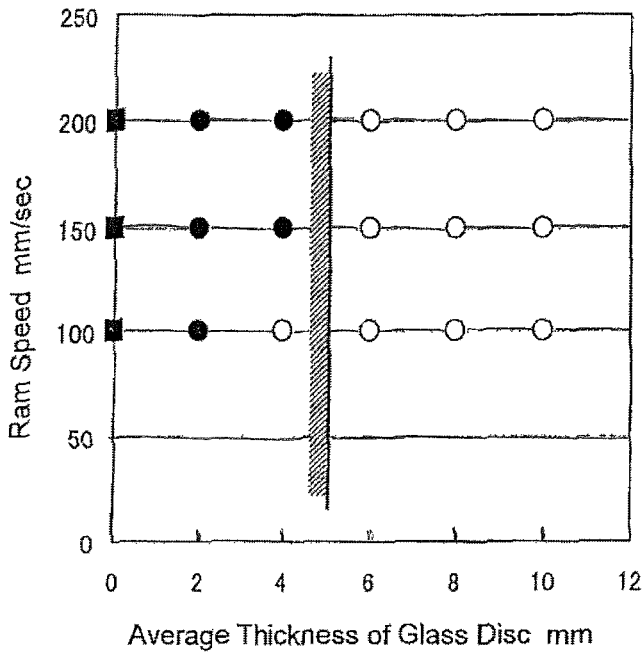
FIG. 3 is a diagram for illustrating an effect on the outer surface flaw of an extruded tube by the average thickness of a glass disc.

FIG. 3 is a diagram for illustrating an effect on the outer surface flaws of the extruded tube by the average thickness of the glass disc. In FIG. 3, the ■ mark (black square mark) indicates that the die seizure occurs due to the absence of the glass disc from the initial stage of extrusion, so that surface flaws occurred throughout the overall length of extruded tube. The ● mark (black round mark) indicates that the die seizure occurs due to the insufficient glass lubrication after the middle stage of extrusion, so that surface flaws range from an intermediate position to a bottom portion of extruded tube, while the number of tubes having such surface flaws is 5% or more against the tested tubes under the relevant condition (one hundred lengths of tubes). The ○ mark (circle mark) indicates that no surface flaw was recognized throughout the overall length of extruded tubes.

From FIG. 3, it can be seen that regardless of the magnitude of ram speed, the glass disc (solid lubricating glass) is indispensable as a lubricant for preventing the seizure of die during extrusion, and depending on the average thickness thereof, the die seizure occurs, and surface flaws occur on the extruded tube. In order to prevent a surface flaw throughout the overall length of extruded tube, the average thickness of solid lubricating glass should preferably made 6 mm or more.

The upper limit of the average thickness thereof is not especially defined, but it is preferably 70 mm or less. If the average thickness of solid lubricating glass is as lame as 70 mm, the quantity of lubricant can be secured sufficiently. When the average thickness thereof is more than 70 mm, the lubricating effect saturates, and merely the cost increases.

3. Composition of Starting Material to be Extruded

In the description below, the symbol "%" for the content of each element means "mass %".

3-1 Material in Use (Containing Cr: 15 to 35% and Ni: 3 to 50%)

In the production method in accordance with the present invention, a starting material to be extruded having the above-described composition is preferably used. The reason for this is that since the starting material to be extruded having the above-described composition has low deformability at high temperatures, when hot extrusion is performed by using the starting material of this composition, in the unsteady portion at the initial stage of extrusion, a transverse flaw is prone to occur on the outer surface due to the spike of the outer surface temperature of the extruded tube.

3-2 Examples of Material in Use

In the production method in accordance with the present invention, as the starting material to be extruded having the above-described composition, an austenitic alloy or a two-phase stainless steel, which has low deformability at high temperatures, is preferably used.

As an austenite stainless steel and an austenitic alloy such as Ni—Cr—Fe alloys, SUS304H, SUS309, SUS310, SUS316H, SUS321H, SUS347H, NCF800, and NCF825, which are specified in JIS, and an alloy equivalent to these, which contain Cr: 15 to 35% and Ni: 6 to 50% as principal composition, can be cited. Besides, A213-TP347H UNS S34709, A213 UNS S30432, A213-TP310HCbN UNS S31042, and B622 UNS NO8535, which are specified in ASTM, and an alloy equivalent to these can be cited.

More specifically, the austenitic alloy is a material comprising C: 0.2% or less, Si: 2.0% or less, Mn: 0.1 to 3.0%, Cr: 1.5 to 30%, and Ni: 6 to 50%, the balance being Fe and impurities. This alloy may contain, wherever needed, in place of part of Fe, one or more elements selected from Mo: 5% or less, W: 10% or less, Cu: 5% or less, N: 0.3% or less, V: 1.0% or less, Nb: 1.5% or less, Ti: 0.5% or less, Ca: 0.2% or less, Mg: 0.2% or less, Al: 0.2% or less, B: 0.2% or less, and rare earth metals: 0.2% or less.

As the two-phase stainless steel, SUS329J1, SUS329J3L, and SUS329J4L, which are specified in JIS, and an alloy equivalent to these, which contain Cr: 20 to 35% and Ni: 3 to 10% as principal composition, can be cited. Besides, A789 UNS S31260, S31803, and S39274, which are specified in ASTM, and an all equivalent to these can be cited.

More, specifically, the two-phase stainless steel is a material comprising C: 0.03% or less, Si: 1% or less, Mn: 0.1 to 2%, Cr: 20 to 35%, Ni: 3 to 10%, and N: 0.15 to 0.60%, the balance being Fe and impurities. This stainless steel may contain, wherever needed, in place of part of Fe, one or more elements selected from Mo: 4% or less, W: 6% or less, Cu: 3% or less, Ca: 0.2% or less, Mg: 0.2% or less, Al: 0.2% or less, B: 0.2% or less, and rare earth metals: 0.2% or less.

3-3 Specific Composition and Reason for Limitation

For the austenitic alloy, for example, SUS347H in JIS Standard, as compared with a common carbon steel S45C, the deformation resistance at the same temperature is as high as 1.5 times or more, the heat generation calorific value resulting from extrusion is high, and the temperature on the outer surface of tube is prone to become high in the unsteady portion at the initial stage of extrusion. Because of these characteristics, in the production method in accordance with the present invention, the austenitic alloy is further preferably used as the starting material to be extruded.

The illustration of specific composition of the austenitic alloy applicable in the present invention has been shown above. Hereunder, action and effects of each element and the reason for limiting the content thereof are explained.

C: 0.2% or Less

C (carbon) is an element effective in securing strength and creep strength. To achieve this effect, 0.01% or more of C is preferably contained. However, if the C content is more than 0.2%, insoluble carbides remain when solution treatment is performed, so that C does not contributes to the increase in high-temperature strength while exerting an adverse effect on the mechanical properties such as toughness. Therefore, the C content is 0.2% or less. To prevent the decrease in hot workability and the deterioration in toughness, it is desirable that the C content is 0.12% or less.

Si: 2.0% or Less

Si (silicon) is an element that is used as a deoxidizer, and moreover an element effective in improving the steam oxidation resistance. Therefore, 0.1% or more of Si is preferably contained. On the other hand, a higher Si content deteriorates the weldability or hot workability. Therefore, the Si content is 2.0% or less. The Si content is preferably 0.8% or less Mn: 0.1 to 3.0%

Mn (manganese) is, like Si, an element effective as a deoxidizer. Also, Mn has an effect of restraining the deterioration in hot workability caused by S contained as an impurity. To achieve the deoxidization effect and to improve the hot workability, 0.1% or more of Mn should be contained. However, excessively contained Mn leads to embrittlement. Therefore, the upper limit of the Mn content is 3.0%. The upper limit thereof is preferably 2.0%.

Cr: 15 to 30%

Cr (chromium) is an element necessary for securing high-temperature strength, oxidation resistance, and corrosion resistance. To achieve these effects, it is necessary to contain 15% or more of Cr. However, excessively contained Cr leads to the deterioration in toughness and hot workability. Therefore, the upper limit of the Cr content is 30%).

Ni: 6 to 50%

Ni (nickel) is an element necessary for stabilizing the austenitic structure and improving the creep strength. To achieve these effects, it is necessary to contain 6% or more of Ni. However, excessively contained Ni saturates these effects, and leads to the increase in cost. Therefore, the upper limit of the Ni content is 50%. The upper limit thereof is preferably 35%, further preferably 25%. In the case where it is desired to secure the stability of micro-structure at higher temperatures for a longer period of time, it is preferable that 15% or more of Ni be contained.

Hereunder, the elements to be contained wherever needed and the compositions thereof are explained.

Mo: 5% or Less, W: 10% or Less, Cu: 5% or Less

Mo (molybdenum), W (tungsten), and Cu (copper) are elements for enhancing the high-temperature strength of alloy. In the case where this effect is necessary, 0.1% or more of any one of these elements is preferably contained. Since these elements, if contained too much, impair the weldability and workability, the upper limit of the Mo content or the Cu content is 5%, and the upper limit of the W content is 10%.

N: 0.3% or Less

N (nitrogen) contributes to the solid-solution strengthening and combines with other elements to achieve an effect of strengthening the alloy by means of the precipitation strengthening action. In the case where these effects are necessary, 0.005% or mere of N is preferably contained. However, if the N content is more than 0.3%, the ductility and weldability are sometimes deteriorated.

V: 1.0% or Less, Nb: 1.5% or Less, Ti: 0.5% or Less

V (vanadium), Nb (niobium), and Ti (titanium) combine with carbon and nitrogen to form carbonitrides, thereby contributing to the precipitation strengthening. Therefore, in the case where this effect is necessary, 0.01% or more of one or more of these elements is preferably contained. On the other hand, if the contents of these elements are excessive, the workability of alloy is impaired. Therefore, the upper limits of the V content, the Nb content, and the Ti content are made 1.0%, 1.5%, and 0.5%, respectively.

Ca: 0.2% or Less, Mg: 0.2% or Less, Al: 0.2% or Less, B: 0.2% or Less, Rare Earth Metals: 0.2% or Less All of Ca, Mg, Al, B, and rare earth metals have an effect of improving the strength, workability, and steam oxidation resistance. In the case where these effects are necessary, each of one or more elements selected from these elements preferably contains 0.0001% or more. On the other hand, if the content of each of these elements is more than 0.2%, the workability or the weldability is impaired. The rare earth metals are the collective term of seventeen elements in which Y and Sc are added to the fifteen elements of lanthanoids, and one or more kinds of these elements can be contained. The content of rare earth metals means the total content of these elements.

As described above, the austenitic stainless steel used as the starting material to be extruded in the production method in accordance with the present invention contains the above-described essential elements and, in some cases, further contains the above-described optional elements, the balance being Fe and impurities. The impurities referred to herein are components that are mixed in by various causes in the production process, including raw materials such as ore and scrap. When the material is produced on a commercial basis and that are allowed to be contained to the extent that no adverse effect is exerted on the present invention.

The hollow starting material to be extruded that is used in the production method in accordance with the present invention can be produced by using production equipment and production method commonly used industrially. For example, for melting, an electric furnace, an argon-oxygen mixed gas bottom blowing decarburization furnace (AOD furnace), a vacuum decarburization furnace (VOD furnace), and the like can be used. The molten steel having been melted may be formed into a billet after being solidified info an ingot by the ingot-making process, or may be cast into round billets by the continuous casting process.

A guide hole is formed by machining along axial centerline of the billet, and, in some cases, expansion piercing for expanding the inside diameter of the billet is further performed by using a piercing press. Thereby, using the obtained hollow billet as the starting material to be extruded, a seamless tube can be produced by the hot extrusion tube-making process of the Ugine-Sejournet process. After being subjected to solution heat treatment, the extruded tube obtained by hot extrusion may be subjected to cold working such as cold rolling or cold drawing to yield a cold seamless tube.

EXAMPLES

To confirm the effects of the production method in accordance with the present invention, hot extrusion tests using the Ugine-Sejournet tube-making process were conducted. In these tests, by using billets made of an austenitic stainless steel (SUS347H in the JIS standards) having the representative composition given in Table 1, hot extrusion was performed by using a glass disc having an average thickness of 6 to 12 mm, and the outer surface of the top portion of the obtained extruded tube was observed visually, whereby the occurrence of transverse flaws was examined. Table 2 gives the dimensions of billets and extruded tubes, the testing conditions including billet heating temperature, and the evaluation result of transverse flaws.

TABLE 2

| | Billet dimensions | | | Extruded tube dimensions | | | Extrusion conditions | | | | Calculated values | | | | Evaluation of transverse |
|---|---|---|---|---|---|---|---|---|---|---|---|---|---|---|---|
| Test No. | Outside diameter $d_0$ [mm] | Wall thickness $t_0$ [mm] | Cross-sectional area [mm$^2$] | Outside diameter d [mm] | Wall thickness t [mm] | Cross-sectional area [mm$^2$] | Extrusion ratio ρ | Heating temperature T [° C.] | Ram speed $V_0$ [mm/s] | Approach length L [mm] | Die passing time A [msec] | ln ($t_0$/t) | ln ($d_0$/d) | Calculated temperature [° C.] | flaw on outer surface in top portion of tube |
| 1 | 176 | 56.0 | 21112 | 76.8 | 6.9 | 1515 | 13.9 | 1210 | 100 | 10 | 13.4 | 2.1 | 0.8 | 1241 | ○ |
| 2 | ↑ | ↑ | ↑ | ↑ | ↑ | ↑ | ↑ | 1210 | 150 | ↑ | 8.9 | ↑ | ↑ | 1235 | ○ |
| 3 | ↑ | ↑ | ↑ | ↑ | ↑ | ↑ | ↑ | 1210 | 200 | ↑ | 6.7 | ↑ | ↑ | 1233 | ○ |
| 4 | ↑ | ↑ | ↑ | ↑ | ↑ | ↑ | ↑ | 1240 * | 150 | ↑ | 8.9 | ↑ | ↑ | 1235 | x |
| 5 | ↑ | ↑ | ↑ | ↑ | ↑ | ↑ | ↑ | 1240 * | 200 | ↑ | 6.7 | ↑ | ↑ | 1233 | x |
| 6 | ↑ | ↑ | ↑ | ↑ | ↑ | ↑ | ↑ | 1245 * | 100 | ↑ | 13.4 | ↑ | ↑ | 1241 | x |
| 7 | 176 | 57.0 | 21309 | 69.0 | 5.0 | 1005 | 21.2 | 1180 | 150 | ↑ | 6.0 | 2.4 | 0.9 | 1228 | ○ |
| 8 | ↑ | ↑ | ↑ | ↑ | ↑ | ↑ | ↑ | 1210 | 150 | ↑ | 6.0 | ↑ | ↑ | 1228 | ○ |
| 9 | ↑ | ↑ | ↑ | ↑ | ↑ | ↑ | ↑ | 1240 * | 150 | ↑ | 6.0 | ↑ | ↑ | 1228 | x |
| 10 | 176 | 61.5 | 22122 | 60.0 | 5.0 | 864 | 25.6 | 1180 | 200 | ↑ | 3.8 | 2.5 | 1.1 | 1224 | ○ |
| 11 | ↑ | ↑ | ↑ | ↑ | ↑ | ↑ | ↑ | 1210 | 150 | ↑ | 5.0 | ↑ | ↑ | 1225 | ○ |
| 12 | ↑ | ↑ | ↑ | ↑ | ↑ | ↑ | ↑ | 1240 * | 150 | ↑ | 5.0 | ↑ | ↑ | 1225 | x |
| 13 | 210 | 83.0 | 33116 | 69.0 | 14.0 | 2419 | 13.7 | 1180 | 100 | 20 | 27.2 | 1.8 | 1.1 | 1225 | ○ |
| 14 | ↑ | ↑ | ↑ | ↑ | ↑ | ↑ | ↑ | 1210 | 100 | ↑ | 27.2 | ↑ | ↑ | 1225 | ○ |
| 15 | ↑ | ↑ | ↑ | ↑ | ↑ | ↑ | ↑ | 1240 * | 200 | ↑ | 13.6 | ↑ | ↑ | 1209 | x |
| 16 | 210 | 75.5 | 31902 | 69.0 | 6.5 | 1276 | 25.0 | 1180 | 150 | ↑ | 10.3 | 2.5 | 1.1 | 1200 | ○ |
| 17 | ↑ | ↑ | ↑ | ↑ | ↑ | ↑ | ↑ | 1210 * | 150 | ↑ | 10.3 | ↑ | ↑ | 1200 | x |
| 18 | ↑ | ↑ | ↑ | ↑ | ↑ | ↑ | ↑ | 1240 * | 100 | ↑ | 15.4 | ↑ | ↑ | 1206 | x |
| 19 | 210 | 89.5 | 33881 | 45.0 | 8.5 | 975 | 34.8 | 1180 | 150 | ↑ | 7.5 | 2.4 | 1.5 | 1194 | ○ |
| 20 | ↑ | ↑ | ↑ | ↑ | ↑ | ↑ | ↑ | 1210 * | 150 | ↑ | 7.5 | ↑ | ↑ | 1194 | x |
| 21 | ↑ | ↑ | ↑ | ↑ | ↑ | ↑ | ↑ | 1240 * | 200 | ↑ | 5.6 | ↑ | ↑ | 1191 | x |

Note)
* mark indicates the value deviating from the range defined in the present invention.

In Table 2, the "Calculated temperature" represents the upper limit value of heating temperature of the starting material to be extruded, which is calculated by the right side of Formula (1) or (2). Also, the ○ mark in the "Evaluation of transverse flaw" column indicates that no transverse flaw was observed on the outer surface in the top portion of tube, and the X mark therein indicates that the transverse flaw(s) was observed.

Test Nos. 1 to 12 are for determining the upper limit of heating temperature by means of Formula (1) defined in the present invention because the outside diameter $d_0$ of billet is less than 200 mm. Among these tests, in test Nos. 1 to 3, 7, 8, 10 and 11, the healing temperature T satisfied the relationship of Formula (1), no transverse flaw occurred on the outer surface in the top portion of tube, and an extruded tube having good outer surface quality was obtained. On the other hand, in test Nos. 4 to 6, 9 and 12, the heating temperature T did not satisfy the relationship of Formula (1), and a transverse flaw(s) occurred.

Test Nos. 13 to 21 are tests for determining the upper limit of heating temperature by means of Formula (2) defined in the present invention because the outside diameter $d_0$ of billet is 200 mm or more. Among these tests, in test Nos. 13, 14, 16 and 19, the heating temperature T satisfied the relationship of Formula (2), and no transverse flaw occurred on the outer surface in the top portion of tube. On the other hand, in test Nos. 15, 17, 18, 20 and 21, the heating temperature T did not satisfy the relationship of Formula (2), and a transverse flaw occurred.

INDUSTRIAL APPLICABILITY

According to the method for producing a seamless tube in accordance with the present invention, when hot extrusion is performed by using a billet having low deformability at high temperatures, the billet is heated to the heating temperature satisfying a conditional expression taking the amount of processing-incurred heat into account depending on the outside diameter of the billet, whereby a transverse flaw on the outer surface in the top portion of an extruded tube can be prevented without an excessive spike of the surface temperature of the extruded tube at the initial stage of extrusion. Therefore, the production method in accordance with the present invention is extremely useful as a technology capable of producing a high-Cr and high-Ni extruded tube having good outer surface quality.

REFERENCE SIGNS LIST

1: glass disc (solid lubricating glass), 2: die, 2*a:* approach portion, 2*b:* bearing portion, 3: mandrel bar, 4: die holder, 5: die backer, 6: container, 7: dummy block, 8: billet (starting material to be extruded)

What is claimed is:

1. A method for producing a metal seamless tube, wherein when a hollow starting material to be extruded is hot extruded by providing a solid lubricating glass between the starting material to be extruded and a die after the hollow starting material has been heated, the starting material is hot extruded by being heated to a heating temperature T [° C.] satisfying the relationship of Formula (1) or Formula (2) depending on the outside diameter $d_0$ [mm] thereof so as to prevent a transverse flaw on an outer surface in a top portion of a tube:

when $d_0<200$:

$$T \leqq 1250+1.1487\times A-7.838\times\ln(t_0/t)-10.135\times\ln(d_0/d) \quad (1)$$

when $d_0 \geqq 200$:

$$T \leqq 1219+1.1487\times A-7.838\times\ln(t_0/t)-10.135\times\ln(d_0/d) \quad (2)$$

where Formulae (1) and (2) are determined by Formulae (3) to (5):

$$A=L/V_{av}\times 1000 \quad (3)$$

$$V_{av}=(V_0+V_0\times\rho)/2 \quad (4)$$

$$\rho=(t_0\times(d_0-t_0)\times\pi)/(t\times(d-t)\times\pi) \quad (5)$$

where $d_0$: outside diameter of starting material to be extruded [mm]

$t_0$: wall thickness of starting material to be extruded [mm]

d: outside diameter of extruded tube [mm]

t: wall thickness of extruded tube [mm]

A: die passing time [msec (millisecond)]

L: length of approach portion along extrusion direction from its inlet end to entry end of following bearing portion of die [mm]

$V_{av}$: average extrusion speed of starting material to be extruded [mm/sec]

$V_0$: ram speed [mm/sec]

ρ: extrusion ratio.

2. The method for producing a metal seamless tube according to claim 1, wherein the starting material to be extruded is made of a composition comprising, in mass%, Cr: 15 to 35% and Ni: 3 to 50%.

3. The method for producing a metal seamless tube according to claim 1, wherein the average thickness of the solid lubricating glass is at least 6 mm.

4. The method for producing a metal seamless tube according to claim 2, wherein the average thickness of the solid lubricating glass is at least 6 mm.

* * * * *